US006565339B2

(12) United States Patent
Lee

(10) Patent No.: US 6,565,339 B2
(45) Date of Patent: May 20, 2003

(54) ABRASION RESISTANCE STRUCTURE OF SCROLL COMPRESSOR

(75) Inventor: Dong Soo Lee, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/041,573

(22) Filed: Jan. 10, 2002

(65) Prior Publication Data

US 2003/0026720 A1 Feb. 6, 2003

(30) Foreign Application Priority Data

Aug. 3, 2001 (KR) ..... 2001-47020

(51) Int. Cl.[7] ..... F04C 18/00
(52) U.S. Cl. ..... 418/55.2; 418/55.1
(58) Field of Search ..... 418/55.2, 55.1

(56) References Cited

U.S. PATENT DOCUMENTS 4,761,122 A * 8/1988 Matsugi et al. ..... 418/55.1

FOREIGN PATENT DOCUMENTS

JP 59176483 A * 10/1984 ..... F04C/18/02
JP 61098987 A * 5/1986 ..... F04C/18/02
JP 64063681 A * 3/1989 ..... 418/55.2
JP 04027787 A * 1/1992 ..... F04C/18/02
JP 04292592 A * 10/1992 ..... F04C/18/02

* cited by examiner

*Primary Examiner*—Thomas Denion
*Assistant Examiner*—Theresa Trieu
(74) *Attorney, Agent, or Firm*—Birch, Stewart, Kolasch & Birch, LLP

(57) ABSTRACT

An abrasion resistance structure of a scroll compressor is provided. In the abrasion resistance structure, including a main frame penetrated by a driving shaft combined with a rotor of a driving motor and supported in a radius direction, a fixed scroll fixed to the main frame, and an orbiting scroll put on the main frame, eccentric-combined with the driving shaft so as to be in an orbiting motion, and forming compression pockets together with the fixed scroll while continuously moving in a state of being geared with the fixed scroll, concavely inclined portions are formed on the back surface of an end plate of the orbiting scroll facing the upper surface of the main frame and on the upper surface of the main frame. Accordingly, it is possible to prevent abrasion between the orbiting scroll and the main frame due to the thermal deformation of the orbiting scroll during the operation of the compressor.

3 Claims, 5 Drawing Sheets

ABRASION RESISTANCE STRUCTURE OF SCROLL COMPRESSOR

BACKGROUND OF THE INVENTION

1. Field of the Invention

The present invention relates to a scroll compressor, and more particularly, to an abrasion resistance structure of a scroll compressor, which is capable of preventing abrasion between a orbiting scroll and a main frame, which is caused by the thermal deformation of the orbiting scroll during the operation of the compressor.

2. Description of the Background Art

In general, a compressor for converting mechanical energy into latent energy of a compressible fluid is divided into a reciprocating compressor, a scroll compressor, a centrifugal compressor, and a vane compressor.

The scroll compressor sucks up and compresses a gas using a solid of revolution and discharges the compressed gas like the centrifugal compressor or the vane compressor unlike the reciprocating compressor.

FIG. 1 is a vertical sectional view showing an example of a conventional scroll compressor.

As shown in FIG. 1, the conventional scroll compressor includes a casing 1 including a suction pipe (SP) and a discharge pipe (DP), a main frame 2 and a sub frame 3 respectively fixed to the upper and the lower sides of the inner circumference of the casing 1, a driving motor 4 including a stator 4A and a rotor 4B loaded between the main frame 2 and the sub frame 3, a driving shaft 5 press fitted to the center of the rotor 4B of the driving motor 4 and penetrating the main frame 2, the driving shaft 5 for transmitting the rotary power of the driving motor 4, a orbiting scroll 6 combined with the driving shaft 5 and put on the upper surface of the main frame 2, a fixed scroll 7 combined with the orbiting scroll 5 and fixed to the upper surface of the main frame 2 so as to form a plurality of compression pockets, a high-pressure-low-pressure dividing plate 8 combined with the back surface of the fixed scroll 7, the high-pressure-low-pressure dividing plate 8 for dividing the inside of the casing 1 into a suction pressure region and a discharge pressure region, and a non-return valve assembly 9 combined with the back surface of the fixed scroll 7, the non-return valve assembly 9 for preventing the reverse flow of the discharged gas.

The main frame 2 has a flat upper surface so that the upper surface forms a thrust bearing surface together with the back surface of an end plate 6*b* of the orbiting scroll 6. The end plate 6*b* of the orbiting scroll 6, which faces the main frame 2, is flat like the upper surface of the main frame 2.

Wraps 6*a* and 7*a* forming an involute curve are formed between the opposite surfaces of the orbiting scroll 6 and the fixed scroll 7 so that the orbiting scroll 6 and the driving motor 4 can form the plurality of compression pockets while the orbiting scroll 6 and the driving motor 4 are geared with each other and continuously move when the orbiting scroll 6 receives the rotary power of the driving motor 4, to thus be in an orbiting motion.

In FIG. 1, a reference numeral 5*a* denotes an oil channel.

The operation of the conventional scroll compressor will now be described.

When power is applied to the stator 4A of the driving motor 4, the rotor 4B rotates together with the driving shaft 5 inside the stator 4A and the orbiting scroll 6 orbits by an eccentric distance. The wrap 6*a* of the orbiting scroll 6 forms the plurality of compression pockets between the wrap 7*a* of the fixed scroll 7. The volumes of the compression pockets are reduced while the compression pockets move toward the center of the scrolls due to the continuous orbiting motion of the orbiting scroll 6. Accordingly, the compression pockets suck up and compress refrigerant gas and discharge the compressed refrigerant gas.

However, in the above-mentioned conventional scroll compressor, since the pressures of the compression pockets positioned in the center of the scrolls 6 and 7 are highest, thermal deformation occurs in the centers of the scrolls due to a rise in temperature according to the increase of the pressure as the compressor continues compression stroke. The thermal deformation causes the orbiting scroll 6 to hang down to the direction of gravity.

At this time, the orbiting scroll 6 forms the thrust bearing surface in a state where the back surface of the end plate 6*b* contacts the upper surface of the main frame 2. However, the main frame 2 and the orbiting scroll 6 press each other since the orbiting scroll 6 locally hangs down due to the thermal deformation of the centers of the scrolls. The back surface of the end plate 6*b* and the upper surface of the main frame 2 are abraded more than the outside of the end plate. Accordingly, noise is generated and the orbiting scroll 6 unstably operates.

SUMMARY OF THE INVENTION

Therefore, an object of the present invention is to provide an abrasion resistance structure of a scroll compressor, which is capable of preventing the back surface of the end plate of an orbiting scroll and the upper surface of a main frame facing the back surface of the end plate from being locally abraded due to the thermal deformation of the orbiting scroll during compression stroke.

To achieve these and other advantages and in accordance with the purpose of the present invention, as embodied and broadly described herein, there is provided an abrasion resistance structure of a scroll compressor, comprising a casing comprising a suction pipe (SP) and a discharge pipe (DP), a main frame and a sub frame respectively fixed to the upper and lower sides of the inner circumference of the casing, a driving motor comprising a stator and a rotor loaded between the main frame and the sub frame, a driving shaft press fitted to the center of the rotor of the driving motor and penetrating the main frame, the driving shaft for transmitting the rotary power of the driving motor, an orbiting scroll combined with the driving shaft, put on the upper surface of the main frame, and having a concavely inclined portion on the back surface of an end plate of the orbiting scroll, a fixed scroll combined with the orbiting scroll and fixed to the upper surface of the main frame so as to form a plurality of compression pockets, and a non-return valve assembly combined with the back surface of the fixed scroll, the non-return valve for preventing the reverse flow of a discharged gas.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
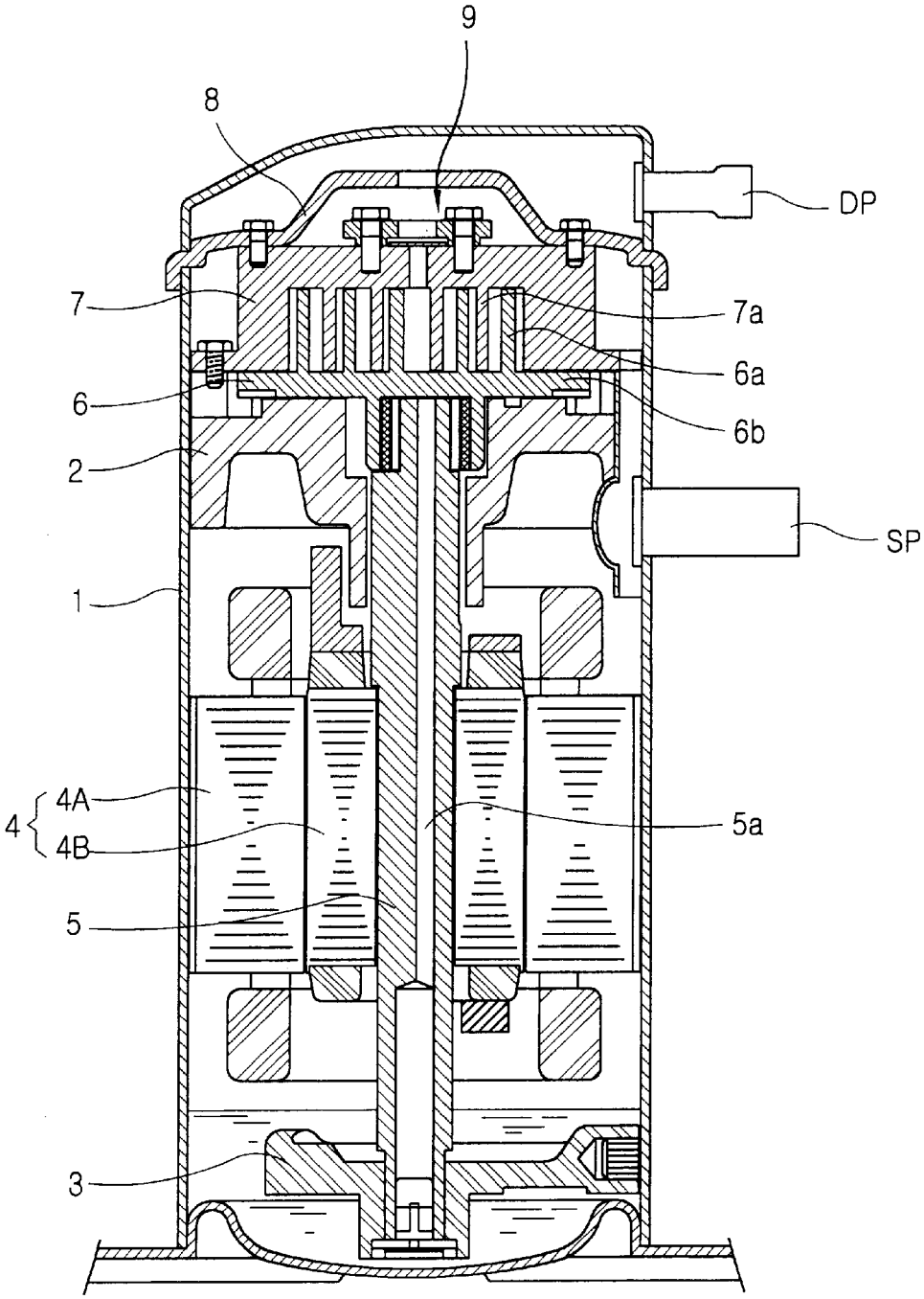
FIG. 1 CONVENTIONAL ART
FIG. 1 is a vertical sectional view of a conventional scroll compressor.
Figure 2:
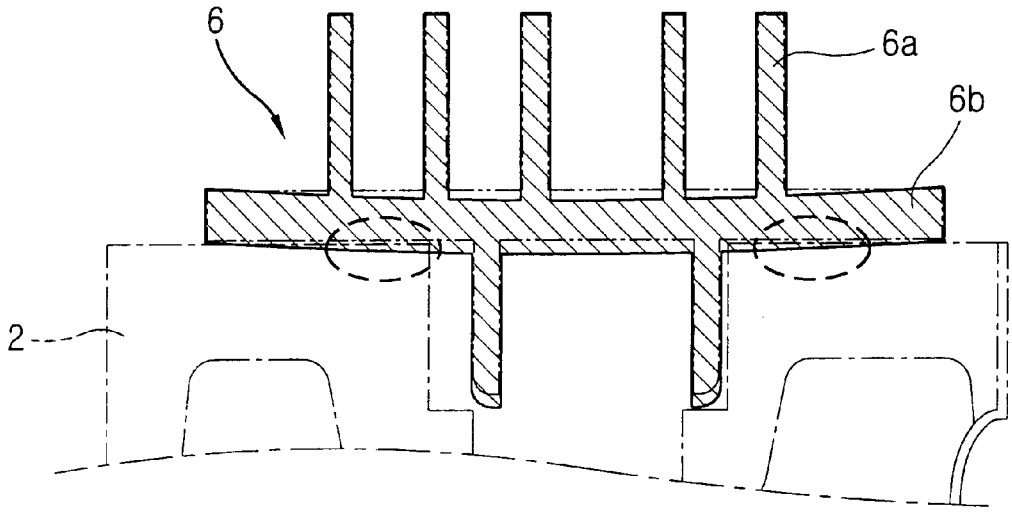
FIG. 2 CONVENTIONAL ART
FIG. 2 is a schematic view showing that an orbiting scroll hangs down due to thermal deformation during the operation of the conventional scroll compressor.

An abrasion resistance structure of a scroll compressor according to the present invention will now be described in detail with reference to an embodiment shown in the attached drawings.

The same reference numerals in different drawings represent the same element.

Figure 3:
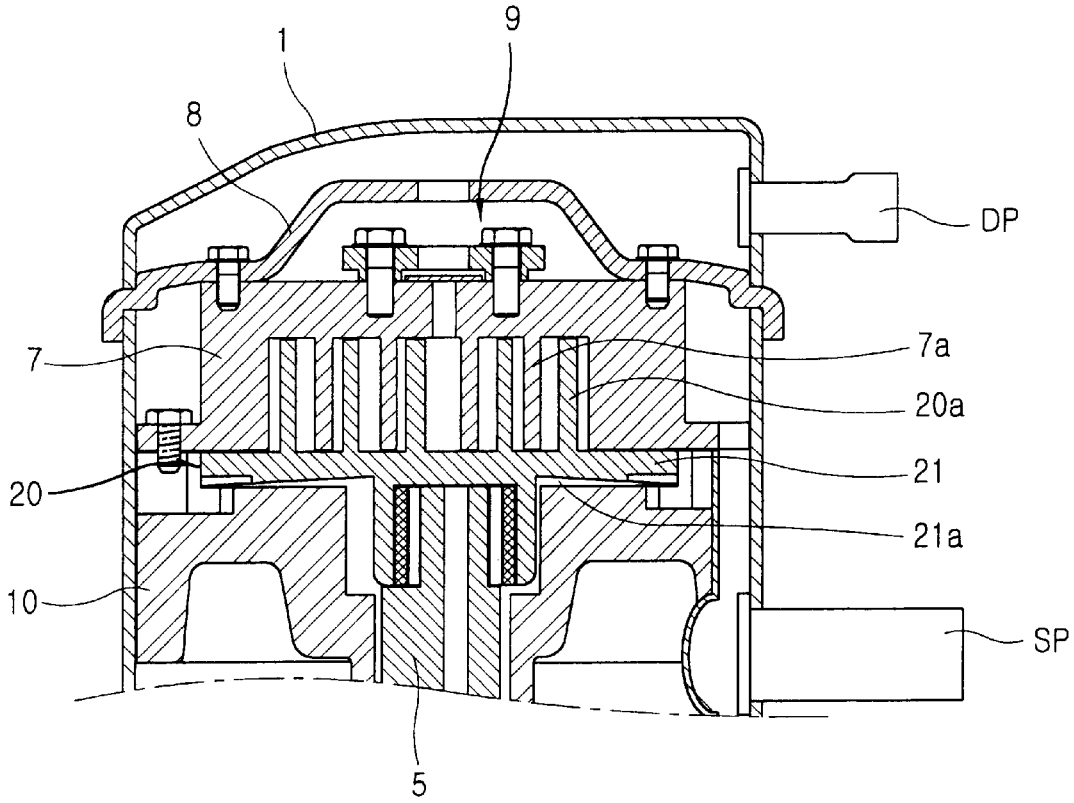
FIG. 3 is a vertical sectional view showing some part of a scroll compressor according to the present invention.
Figure 4:
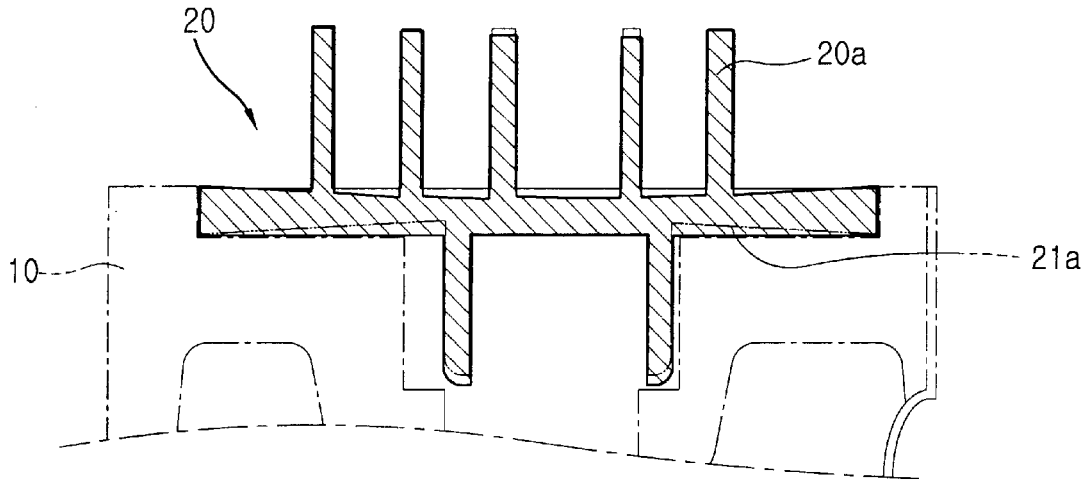
FIG. 4 is a schematic view showing that the thermally deformed orbiting scroll contacts a main frame after an abrasion resistance structure according to the present invention is applied during the operation of the scroll compressor according to the present invention.
Figure 5:
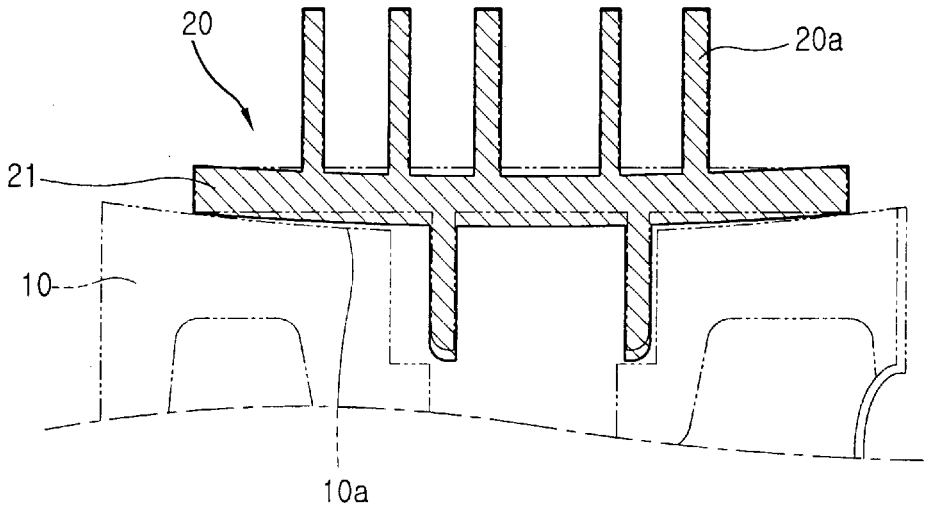
FIG. 5 is a schematic view showing that the thermally deformed orbiting scroll contacts the main frame after another abrasion resistance structure according to the present invention is applied during the operation of the scroll compressor according to the present invention.

FIG. 3 is a vertical sectional view showing a scroll compressor according to the present invention. FIGS. 4 and 5 are vertical sectional views showing that a thermally deformed orbiting scroll contacts a main frame during the operation of the scroll compressor according to the present invention.

As shown in FIG. 3, the scroll compressor according to the present invention includes a casing 1 including a suction pipe (SP) and a discharge pipe (DP), a main frame 10 and the sub frame 3 (shown in FIG. 1) respectively fixed to the upper and lower sides of the inner circumference of the casing 1, a driving motor 4 including the stator 4A (shown in FIG. 1) and the rotor 4B (shown in FIG. 1) installed between the main frame 10 and the sub frame 3, a driving shaft 5 press fitted to the center of the rotor 4B of the driving motor 4 and penetrating the main frame 10, to thus transmit the rotary power of the driving motor 4, an orbiting scroll 20 combined with the driving shaft 5 and put on the upper surface of the main frame 10, a fixed scroll 7 combined with the orbiting scroll 20 and fixed to the upper surface of the main frame 10 so as to form a plurality of compression pockets, and a non-return valve assembly 9 combined with the back surface of the fixed scroll 7, the non-return valve assembly 9 for preventing the reverse flow of the discharged gas.

Wraps 7*a* and 20*a* forming an involute curve are formed between the opposite surfaces of the fixed scroll 7 and the orbiting scroll 20 so that the orbiting scroll 20 and the driving motor 4 can form the plurality of compression pockets while the orbiting scroll 20 and the driving motor 4 are geared with each other and continuously move when the orbiting scroll 20 receives the rotary power of the driving motor 4, to thus be in an orbiting motion.

The main frame 10 has a flat upper surface so that the upper surface forms a thrust bearing surface together with the back surface of an end plate 21 of the orbiting scroll 20. As shown in FIG. 4, a concavely inclined portion 21*a* having a uniform curvature upward from the edge toward the center is formed on the back surface of the end plate 21 of the orbiting scroll 20 facing the upper surface of the main frame 10, considering the thermal deformation in the final compression pocket.

As shown in FIG. 5, the back surface of the end plate 21 of the orbiting scroll 20 is formed to be flat. A concavely inclined portion 10*a* having a uniform curvature downward from the edge toward the center is formed on the upper surface of the main frame 10 facing the back surface of the end plate 21 of the orbiting scroll 20, considering the thermal deformation in the final compression pocket.

The operation and the effect of the scroll compressor according to the present invention will now be described.

When the power is applied to the stator 4A of the driving motor 4, the rotor 4B rotates together with the driving shaft 5 inside the stator 4A and the orbiting scroll 20 orbits by the eccentric distance. The wrap 20*a* of the orbiting scroll 20 forms the plurality of compression pockets between the wrap 20*a* of the orbiting scroll 20 and the wrap 7*a* of the fixed scroll 7. The volumes of the compression pockets are reduced while moving to the center of the scrolls due to the continuous orbiting motion of the orbiting scroll 20. Accordingly, the compression pockets suck up and compress the refrigerant gas. The compressed gas is discharged into the discharge pressure region and is discharged into the outside of the casing 1 through the discharge pipe (DP).

At this time, since the refrigerant gas is gradually compressed while moving from the compression pocket at the edge to the compression pocket in the center, the temperature of the compression pocket in the center rapidly rises. Accordingly, the centers of the orbiting scroll 20 and the fixed scroll 7 hang down due to the thermal deformation. Therefore, the back surface of the end plate 21 of the orbiting scroll 20 abrades the upper portion of the main frame 10. However, when the concavely inclined portion 21*a* is positioned upward on the back surface of the end plate 21 of the orbiting scroll 20 according to the present invention, the amount of the hung portion of the thermally deformed orbiting scroll 20 is previously reduced. Also, when the concavely inclined portion 10*a* is positioned downward on the upper portion of the main frame 10, the amount of the hung portion of the orbiting scroll is previously secured. Accordingly, it is possible to prevent the abrasion between the orbiting scroll 20 and the main frame 10, which may be caused during the operation of the compressor.

Therefore, in the abrasion resistance structure of the scroll compressor according to the present invention, it is possible to prevent the abrasion between the orbiting scroll and the main frame due to the thermal deformation of the orbiting scroll during the operation of the compressor by forming the concavely inclined portions on the upper surface of the main frame and on the back surface of the orbiting scroll corresponding to the upper surface of the main frame.

What is claimed is:

1. An abrasion resistance structure of a scroll compressor, comprising:

a casing comprising a suction pipe and a discharge pipe;

a main frame fixed to the upper side of the inner circumference of the casing and having a concavely inclined portion on the upper portion and a sub frame fixed to the lower side of the inner circumference of the casing;

a driving motor comprising a stator and a rotor loaded between the main frame and the sub frame;

a driving shaft press fitted to the center of the rotor of the driving motor and penetrating the main frame, the driving shaft for transmitting the rotary power of the driving motor;

an orbiting scroll combined with the driving shaft and put on the upper surface of the main frame;

a fixed scroll combined with the orbiting scroll and fixed to the upper surface of the main frame so as to form a plurality of compression pockets; and a non-return valve assembly combined with the back surface of the fixed scroll, the non-return valve for preventing the reverse flow of a discharged gas.

2. The abrasion resistance structure of claim 1, wherein the inclined portion is formed toward the sub frame to be deeper from the edge of the main frame toward the center with a uniform curvature.

3. An abrasion resistance structure of a scroll compressor, comprising:

a casing comprising a suction pipe and a discharge pipe;

a main frame and a sub frame respectively fixed to the upper and lower sides of the inner circumference of the casing;

a driving motor comprising a stator and a rotor loaded between the main frame and the sub frame;

a driving shaft press fitted to the center of the rotor of the driving motor and penetrating the main frame, the driving shaft for transmitting the rotary power of the driving motor;

an orbiting scroll combined with the driving shaft, put on the upper surface of the main frame, and having a concavely inclined portion on the back surface of an end plate of the orbiting scroll, wherein the inclined portion is formed toward the stationary scroll to be deeper from the edge of the orbiting scroll toward the center with a uniform curvature;

a stationary scroll combined with the orbiting scroll and fixed to the upper surface of the main frame so as to form a plurality of compression pockets; and a non-return valve assembly combined with the back surface of the stationary scroll, the non-return valve for preventing the reverse flow of a discharged gas.

* * * * *